US006182634B1

(12) United States Patent
Caldwell et al.

(10) Patent No.: US 6,182,634 B1
(45) Date of Patent: Feb. 6, 2001

(54) LOW RPM SWITCHING TACHOMETER

(75) Inventors: Sarah D. Caldwell; Robert Q. Elliott; John E. Francis, all of Raleigh, NC (US); W. Frank Landon, Abingdon, IL (US); David M. Smith, Moravia, NY (US); Stephen M. Sturhahn, Peoria, IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/416,997

(22) Filed: Oct. 13, 1999

(51) Int. Cl.[7] ..... F02D 41/02; F02D 31/00

(52) U.S. Cl. ..... 123/339.16; 123/339.14; 123/339.19; 123/352

(58) Field of Search ..... 123/339.16, 339.1, 123/339.14, 339.15, 339.19, 350, 352; 280/702, 707; 477/107, 110, 111

(56) References Cited

U.S. PATENT DOCUMENTS

| | | | | |
|---|---|---|---|---|
| 4,080,940 | * | 3/1978 | Fuzzell et al. | 123/333 |
| 4,425,766 | * | 1/1984 | Claypole | 62/133 |
| 4,442,424 | | 4/1984 | Shirasaki et al. | 340/52 F |
| 4,665,319 | * | 5/1987 | Seepe et al. | 290/3 |
| 4,702,843 | * | 10/1987 | Oswald et al. | 280/707 |
| 4,873,891 | | 10/1989 | Guanciale | 74/625 |
| 4,993,383 | * | 2/1991 | Wokan et al. | 123/339.17 |
| 5,448,925 | | 9/1995 | McFadden | 74/335 |
| 5,480,364 | * | 1/1996 | Hilbert et al. | 477/107 |
| 5,612,672 | | 3/1997 | Ino et al. | 340/449 |
| 5,722,293 | | 3/1998 | McFadden | 74/336 R |
| 5,905,374 | | 5/1999 | Westberg et al. | 324/160 |

* cited by examiner

*Primary Examiner*—Henry C. Yuen
*Assistant Examiner*—Hieu T. Vo
(74) *Attorney, Agent, or Firm*—Diana L. Charlton

(57) ABSTRACT

The present invention includes preventing an engine from stalling at a preselected low idle range during operation of a work machine. To accomplish this, a controller is located within a tachometer and disposed on the work machine. The controller is responsive to a first specified low idle RPM signal from the engine. The controller converts the RPM signal to an electrical signal that is directed to a relay. The relay is responsive to the electrical signal to automatically switch at least one device operating on the work machine from a first power output level to a second power output level lower than the first power output level. The controller is responsive to a second specified low idle RPM signal from the engine and converts it to another electrical signal. The relay is responsive to the another electrical signal to automatically switch the at least one device from the second power output level to the first power output level so that the engine is maintained within the preselected low idle range throughout operation of the work machine. This allows the preselected low idle range of the engine to have a lower RPM capability for smoother and more precise operational control of the work machine.

20 Claims, 2 Drawing Sheets

LOW RPM SWITCHING TACHOMETER

TECHNICAL FIELD

This invention relates generally to a low RPM switching tachometer and more particularly to utilizing the tachometer for switching power draining devices on a work machine to a lower power output level when the engine is running at a specific RPM within a low idle range so that engine stalling is prevented.

1. Background Art

Present work machines utilize various devices, such as implement pumps, air conditioning compressors, fans, and the like that reduce the power or RPM of an engine during operation. Generally, such a reduction in the RPM of the engine does not affect the smooth operation of the work machine. However, when the engine is running at a low RPM or within a low idle range, any additional reduction of engine power brought about by any one of these devices may cause the engine to stall. Typically, in order to overcome the stalling problem, most work machines have incorporated a higher RPM capability within the low idle range. Unfortunately, such an increase in the RPM for the low idle range may limit performance of the work machine because certain operations may be conducted at too high an RPM level. Therefore, it is important to be able to automatically switch any one of these devices to a lower power output level when the engine is within the low idle range without incorporating a higher RPM capability to prevent stalling of the engine.

The present invention is directed to overcoming the problems as set forth above.

2. Disclosure of the Invention

In one aspect of the present invention, a work machine is disclosed that has an engine producing a rotational speed between a preselected low idle range and a preselected high idle range, an electrical power source, means for generating signals commensurate with rotational speed of the engine (RPM), and a tachometer for providing visual indication of the RPM. The work machine comprises at least one device operatively associated with the work machine. The device produces a power output measurable between a plurality of levels. A controller is locatable within the tachometer and is responsive to the RPM signal when the engine is at a first specified RPM within the preselected low idle range. The controller converts the RPM signal to an electrical signal. A relay is located in line between the controller and the at least one device. The relay is responsive to the electrical signal from the controller for automatically switching the at least one device from a first power output level to a second power output level that is lower than the first power output level.

In another aspect of the present invention, a method of preventing an engine from stalling during operation of a work machine is disclosed. The engine is operatively associated with the work machine and produces a rotational speed between a preselected low idle range and a preselected high idle range. The work machine includes an electrical power source, means for generating signals commensurate with rotational speed of the engine (RPM), and a tachometer for providing visual indication of the RPM. The method comprises the steps of operating at least one device with a specific function for the work machine at a power output measurable between a plurality of levels. Then, converting the RPM signal to an electrical signal when the engine is at a first specified RPM within the preselected low idle range. Finally, automatically switching the at least one device in response to the electrical signal from a first power output level to a second power output level that is lower than the first power output level to maintain the engine within the preselected low idle range.

In yet another aspect of the present invention, a work machine is disclosed that has an engine producing a rotational speed between a preselected low idle range and a preselected high idle range, an electrical power source, means for generating signals commensurate with rotational speed of the engine (RPM), and a tachometer for providing visual indication of the RPM. The work machine comprises at least one device operatively associated with the work machine. The device produces a power output measurable between a plurality of levels. A controller in communication with the tachometer and responsive to the RPM signal when the engine is at a first specified RPM within the preselected low idle range. The controller converts the RPM signal to an electrical signal. A relay is located in line between the controller and the at least one device. The relay is responsive to the electrical signal from the controller for automatically switching the at least one device from a first power output level to a second power output level that is lower than the first power output level.

The present invention prevents an engine, running within a low idle range, from stalling during operation of a work machine. The present invention includes a controller within a tachometer that is responsive to a first specified low idle RPM signal from the engine. The controller converts the RPM signal to an electrical signal that is directed to a relay. The relay is responsive to the electrical signal to automatically switch at least one device from a first power output level to a second power output level lower than the first power output level. The ability to automatically switch the at least one device to a lower power output level, when the engine is at a specified low idle RPM, maintains the engine within the preselected low idle range. This allows the preselected low idle range of the engine to have a lower RPM capability for smoother and more precise operational control of the work machine.

BEST MODE FOR CARRYING OUT THE INVENTION

Figure 1:
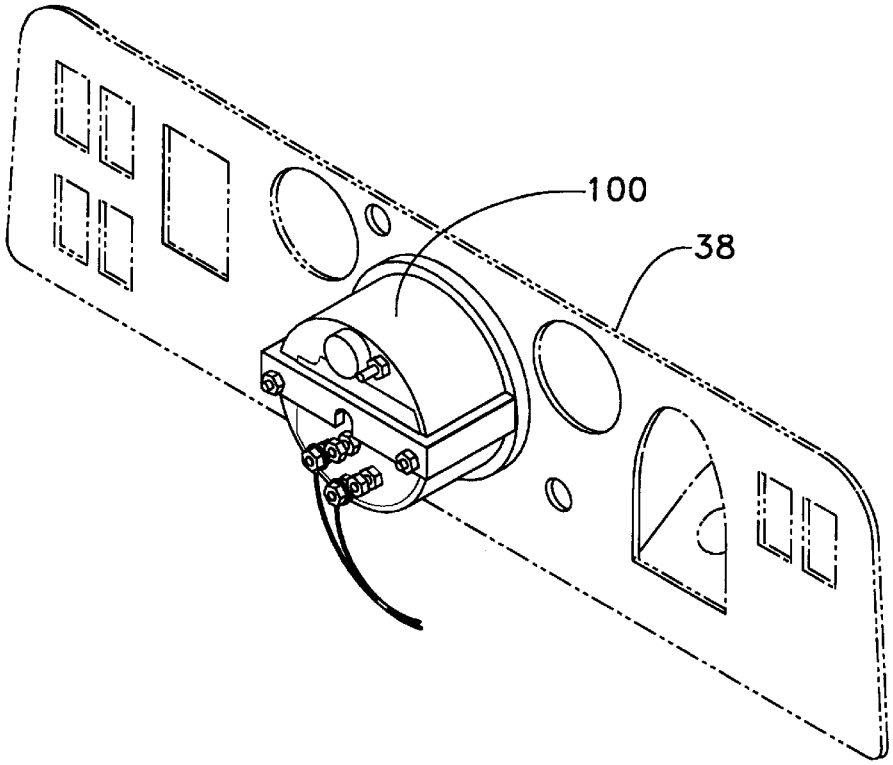
FIG. 1 is a perspective view of a work machine of the present invention.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
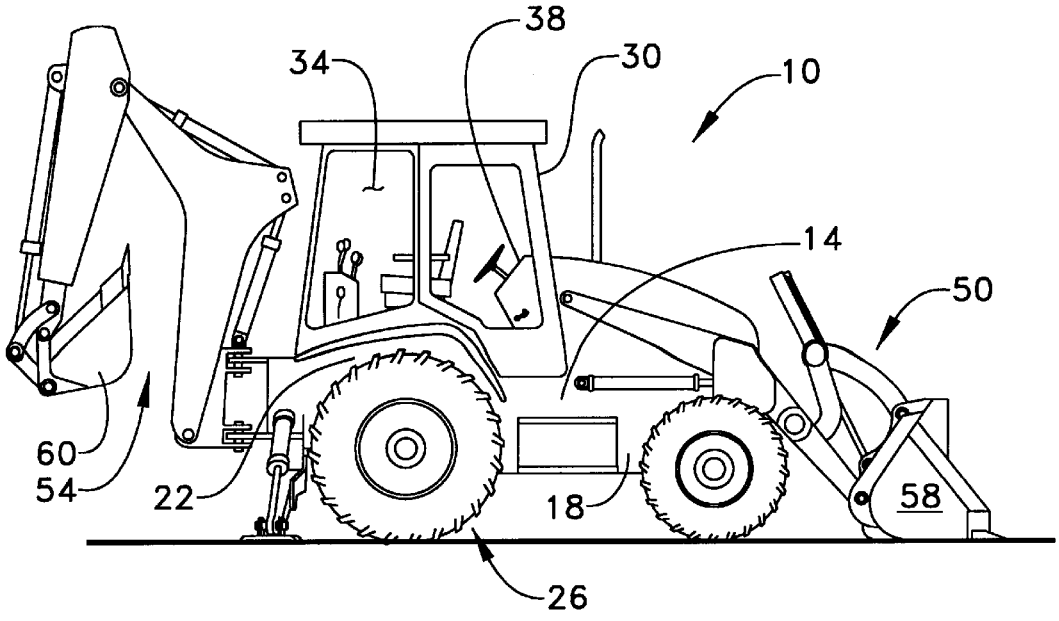
FIG. 2 is a diagrammatic, perspective illustration of a tachometer featuring a portion of the present invention.

Referring to FIGS. 1–2, a work machine 10, such as a backhoe loader, is shown which has a frame 14 with front and rear end portions 18,22 and a plurality of wheels 26 supporting the frame 14. A cab portion 30 is mounted on the frame 14 between the front and rear end portions 18,22 and includes an interior region 34. An operator panel 38 is mounted on the work machine 10 within the interior region 34. Loader and backhoe assemblies 50,54 are mounted at the front and rear end portions 18,22, respectively, of the frame 14 in a well-known manner. The loader and backhoe assemblies 50,54 include an implement 58,60 such as a bucket, mounted at a respective distal end portion thereof.

Figure 3:
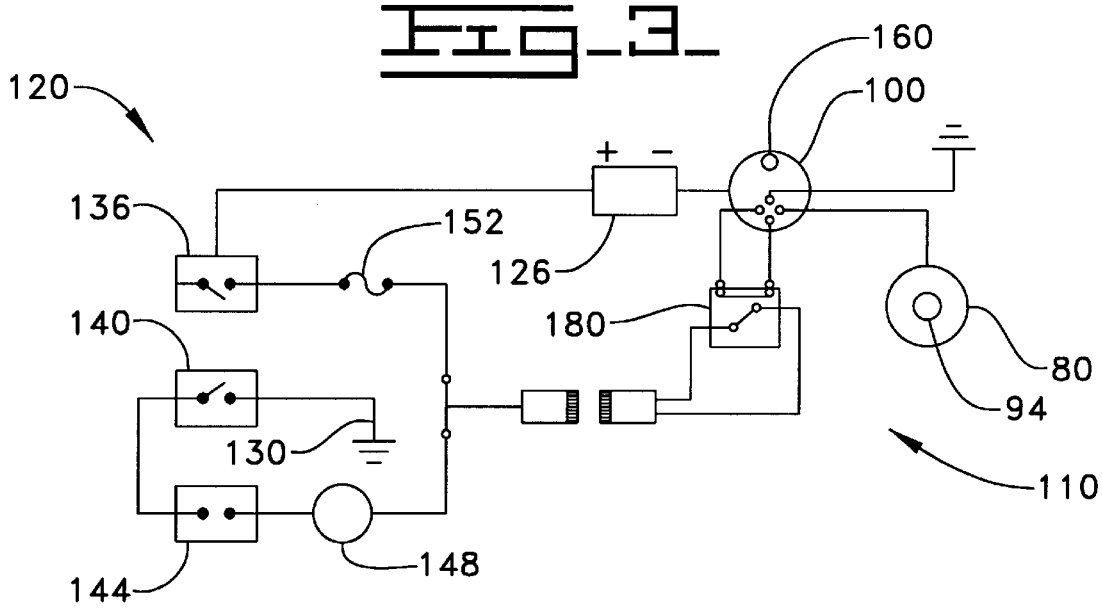
FIG. 3 is a partly schematic, partly diagrammatic illustration of a first embodiment of present invention.

As seen schematically in FIG. 3, an engine 80 is mounted in a well-known manner within an interior portion of the frame 14. The engine 80 is capable of producing a rotational speed between a preselected low idle range of approximately 800 RPM to 980 RPM and a preselected high idle range of approximately 2290 RPM to 2435 RPM. It should be understood that the preselected low idle range of the engine 80 includes a portion of a low idle lug range from 800 RPM to 920 RPM. Means 94, such as a speed sensor, is used for generating pulse signals commensurate with the rotational speed or RPM of the engine 80. The generating means 94 is mounted on the engine 80 in any suitable manner. A tachometer 100 is mounted in any suitable manner within the operator panel 38 and is connected with the speed sensor 94 to provide an RPM readout or indicator for an operator (not shown) correlating to the RPM fluctuations of the engine 80.

A method 110 of preventing the engine 80 from stalling when the engine 80 is running within the preselected low idle range is shown specifically in a first embodiment of FIG. 3. In this embodiment, an air conditioning circuit 120 of a well-known design is shown which is connected to an electrical power source 126, such as a battery, mounted in any suitable manner to the frame 14. The air conditioning circuit 120 is grounded in any suitable manner, as seen at 130. The air conditioning circuit 120 includes a plurality of switches, such as a main air conditioning switch 136, a thermostat switch 140, and a refrigerant switch 144. The switches 136,140,144 are movable between an open position that produces a first power output level and a closed position that produces a second power output level. The switches 136,140,144 are connected in line with a compressor clutch 148 and compressor fuse 152 and are operable therewith in a well-known manner to facilitate the supply of cold air to the cab portion 30 of the work machine 10. A controller 160, seen diagrammatically in FIG. 3, is located within the tachometer 100 and connected to the speed sensor 94. It should be understood that the controller 160 is of any suitable design. Furthermore, it should also be understood that the controller 160 may be located remotely from the tachometer 100 but in communication therewith. A relay 180 is connected in line between the controller 160 and the air conditioning circuit 120.

Figure 4:
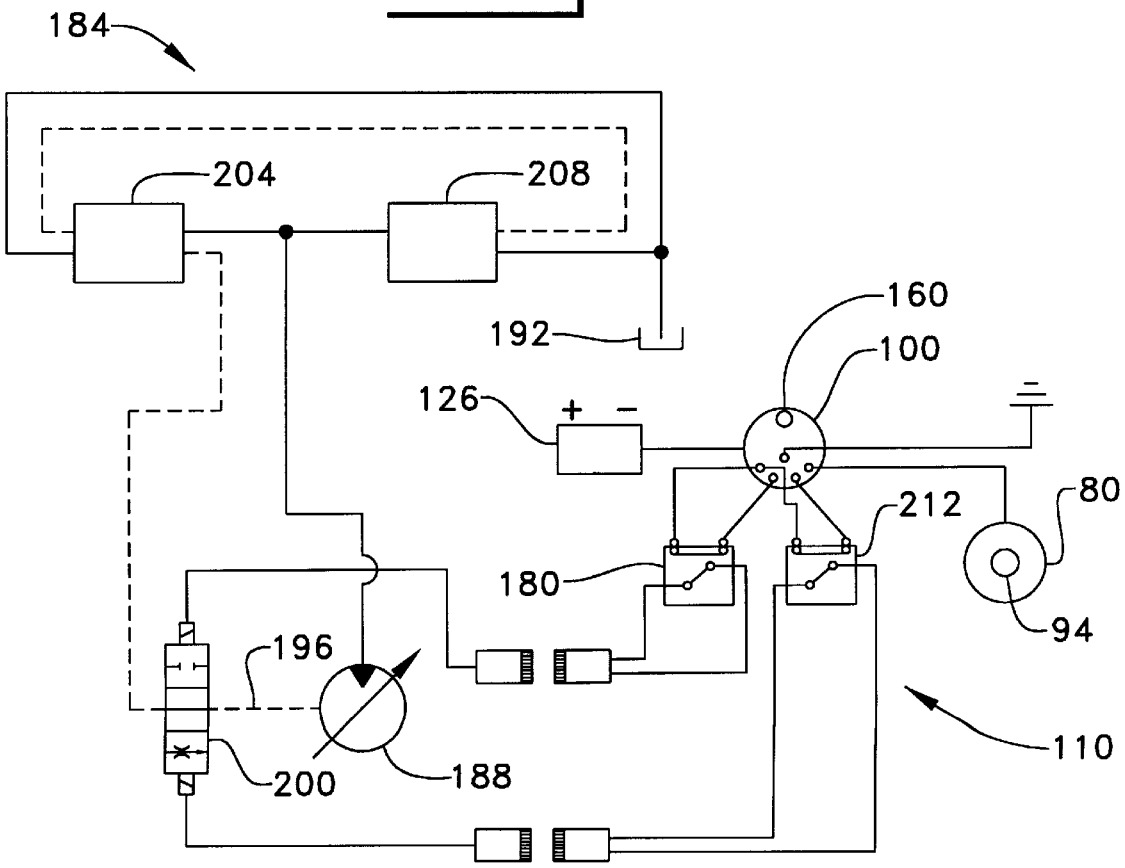
FIG. 4 is a partly schematic, partly diagrammatic illustration of an alternate embodiment of the present invention.

An alternate embodiment of the present invention is shown in FIG. 4. It should be understood that identical elements of FIG. 3 are designated by the same reference numerals in FIG. 4.

In the embodiment of FIG. 4, another method 110 of preventing the engine 80 from stalling when the engine 80 is running within the preselected low idle range is shown. An electro-hydraulic circuit 184 controls the loader and backhoe assemblies 50,54. The electro-hydraulic circuit 184 receives a source of hydraulic fluid from a pump 188 via a tank 192, seen schematically in FIG. 4. The pump 188 is a variable displacement design that includes a pump flow compensator (not shown) and torque limiter (not shown). The electro-hydraulic circuit 184 includes at least one solenoid valve 200 connected with the pump 188 via a load sense signal line 196. The solenoid valve 200 is a three position valve that is movable between an open position that produces a first power output level and a closed position that produces a second power output level. When the solenoid valve 200 is in the open position, the solenoid valve 200 utilizes a first orifice (not shown) of a predetermined size that establishes the hydraulic flow and pressure within the load sense signal line 196. The solenoid valve 200 is also movable between the open position that produces the first power output level and a restricted position that produces a second power output level. When the solenoid valve 200 is in the restricted position, the solenoid valve 200 utilizes a second orifice (not shown) of a predetermined size smaller than the first orifice that establishes a different hydraulic flow pressure within the load sense signal line 196. The open and restricted positions of the solenoid valve 200 permits a flow of hydraulic fluid to enter the pump 188 via the load sense signal line 196. Control valves 204,208 of any suitable type are disposed within the electro-hydraulic circuit 184. The control valves 204,208 communicate with the pump 188 via signal lines for operating the implements 58,60. The relay 180 is connected in line between the controller 160 and the electro-hydraulic circuit 184 for communication with a first end of the solenoid valve 200. An additional relay 212 is connected in line between the controller 160 and the electro-hydraulic circuit 184 for communication with a second end of the solenoid valve 200.

Industrial Applicability

The method 110 of preventing the engine 80 from stalling when operating within the preselected low idle range includes the ability to control power drainage on the engine 80 during this time. Therefore, when specific functional devices of the work machine 10, such as the electrical circuit 120 for the air conditioner, electro-hydraulic circuit 184 for implement control, electro-hydraulic circuit (not shown) for transmission control, electrical circuit (not shown) for fans, or other similar devices, are being operated during this time, the power output levels of these devices may need to be reduced to prevent engine stalling during operation within the preselected low idle range.

Specifically, engine stalling during operation within the preselected low idle range may be prevented as shown in the embodiment of FIG. 3. In this embodiment, the controller 160 converts the RPM pulse signal from the speed sensor 94 to an electrical signal when the engine 80 is at approximately 800 RPM dropping. In response to the electrical signal from the controller 160, the relay 180 automatically switches one of the switches 136,140,144 within the air conditioning circuit 120 from the closed position to the open position to disengage the compressor clutch 148. Therefore, the power output of the air conditioning circuit 120 is reduced to zero so that the engine 80 may be maintained within the preselected low idle range. This occurs because the engine 80 is not additionally drained of power by operating the air conditioning circuit 62 below a specified RPM level of the engine 80. When the engine 80 reaches approximately 900 RPM rising, the relay 180 automatically switches the opened switch 136,140,144 to the closed position to re-engage the compressor clutch 148.

Engine stalling during operation within the preselected low idle range may also be prevented, as shown in the alternate embodiment of FIG. 4, by utilizing the open and closed positions of the solenoid valve 200. The controller 160 converts the RPM pulse signal from the speed sensor 94 to an electrical signal when the engine 80 is at approximately 800 RPM dropping. In response to the electrical signal from the controller 160, the relay 180 automatically switches the solenoid valve 200 within the electro-hydraulic circuit 184 from the open position to the closed position to reduce hydraulic power to the implements 58,60 by eliminating hydraulic flow to the respective control valves 204,208. Therefore, the power output of the electro-hydraulic circuit 194 is reduced to zero so that the engine 80 may be maintained within the preselected low idle range. This occurs because the engine 80 is not additionally drained of power by driving the electro-hydraulic circuit 184 below a specified RPM level. When the engine 80 reaches approximately 900 RPM rising, the relay 180 automatically switches the solenoid valve 200 from the closed position to the open position to increase hydraulic power to the implements 58,60.

Engine stalling during operation within the preselected low idle range may further be prevented, as shown in the alternate embodiment of FIG. 4, by utilizing the open and restricted positions of the solenoid valve 200. The controller 160 converts the RPM pulse signal from the speed sensor 94 to an electrical signal when the engine 80 is at approximately 830 RPM dropping. In response to the electrical signal from the controller 160, the relay 212 automatically switches the solenoid valve 200 within the electro-hydraulic circuit 184 from the open position to the restricted position. The restricted position of the solenoid valve 200 involves the use of the smaller orifice (not shown), which transmits a lower hydraulic flow and pressure through the load sense signal line 196. The pump flow compensator (not shown) controls the pump flow based on the load sense pressure within the load sense signal line 196. The torque limiter (not shown) senses both the load sense pressure and the displacement of the pump 188. When the load sense pressure and the displacement of the pump 188 reach a level that is pre-set on the torque limiter (not shown), the torque limiter (not shown) will relieve some of the load sense pressure. This results in less pressure at the pump flow compensator (not shown), which reduces pump displacement and flow. Therefore, hydraulic power to the implements 58,60 is reduced by the resulting lower hydraulic flow to the respective control valves 204,208. It should be understood that the hydraulic flow to the control valves 204,208 may be controlled in such a manner that the implements 58,60 operate at different hydraulic power levels based upon the orifice sizes of the respective signal lines from the pump 188. When the engine 80 reaches approximately 900 RPM rising, the relay 212 automatically switches the solenoid valve 200 from the restricted position to the open position to increase hydraulic power to the implements 58,60.

It should also be understood that the power output of the air conditioning circuit 120 and the electro-hydraulic circuit 184 may be reduced simultaneously to maintain the engine 80 within the preselected low idle range. Additionally, it should be understood that other functional, power draining devices of the work machine 10 may be controlled in a similar manner, either individually or in combination, to maintain the engine within the preselected low idle range.

Other aspects, objects and advantages of this invention can be obtained from a study of the drawings, disclosure and the appended claims.

What is claimed is:

1. A work machine having an engine producing a rotational speed between a preselected low idle range and a preselected high idle range, an electrical power source, means for generating signals commensurate with rotational speed of the engine (RPM), and a tachometer for providing visual indication of the RPM, comprising:

at least one device operatively associated with the work machine, the at least one device producing a power output measurable between a plurality of levels;

a controller in communication with the tachometer and being responsive to the RPM signal when the engine is at a first specified RPM within the preselected low idle range, the controller converting the RPM signal to an electrical signal;

a relay located in line between the controller and the at least one device, the relay being responsive to the electrical signal from the controller for automatically switching the at least one device from a first power output level to a second power output level that is lower than the first power output level.

2. The work machine of claim 1, wherein the controller is responsive to the RPM signal when the engine is at a second specified RPM within the preselected low idle range, the controller converting the RPM signal to another electrical signal that the relay is responsive to for automatically switching the at least one device from the second power output level to the first power output level.

3. The work machine of claim 1, wherein the at least one device is an electrical circuit including a switch.

4. The work machine of claim 1, wherein the at least one device is a electro-hydraulic circuit including a solenoid valve.

5. A work machine having an engine producing a rotational speed between a preselected low idle range and a preselected high idle range, an electrical power source, means for generating signals commensurate with rotational speed of the engine (RPM), and a tachometer for providing visual indication of the RPM, comprising:

at least one device operatively associated with the work machine, the at least one device producing a power output measurable between a plurality of levels;

a controller locatable within the tachometer and being responsive to the RPM signal when the engine is at a first specified RPM within the preselected low idle range, the controller converting the RPM signal to an electrical signal;

a relay located in line between the controller and the at least one device, the relay being responsive to the electrical signal from the controller for automatically switching the at least one device from a first power output level to a second power output level that is lower than the first power output level.

6. The work machine of claim 5, wherein the controller is responsive to the RPM signal when the engine is at a second specified RPM within the preselected low idle range, the controller converting the RPM signal to another electrical signal that the relay is responsive to for automatically switching the at least one device from the second power output level to the first power output level.

7. The work machine of claim 6, wherein the first specified RPM is lower than the second specified RPM.

8. The work machine of claim 5, wherein the at least one device is an electrical circuit including a switch.

9. The work machine of claim 8, wherein the second power output level is zero.

10. The work machine of claim 5, wherein the at least one device is a electro-hydraulic circuit including a solenoid valve.

11. The work machine of claim 10, wherein the second power output level is zero.

12. A method of preventing an engine from stalling during operation of a work machine, the engine being operatively associated with the work machine and producing a rotational speed between a preselected low idle range and a preselected high idle range, the work machine including an electrical power source, means for generating signals commensurate with rotational speed of the engine (RPM), and a tachometer for providing visual indication of the RPM, the method comprising the steps of:

operating at least one device with a specific function for the work machine at a power output measurable between a plurality of levels;

converting the RPM signal to an electrical signal when the engine is at a first specified RPM within the preselected low idle range; and automatically switching the at least one device in response to the electrical signal from a first power output level to a second power output level that is lower than the first power output level to maintain the engine within the preselected low idle range.

13. The method of preventing the engine from stalling of claim 12, including the steps of:

operating at least one other device with a specific function for the work machine at a power output measurable between a plurality of levels; and automatically switching the at least one device and the at least one other device simultaneously in response to the electrical signal from a first power output level to a second power output level that is lower than the first power output level to maintain the engine within the preselected low idle range.

14. The method of preventing the engine from stalling of claim 12, including the steps of:

utilizing a controller located within the tachometer for converting the RPM signal to an electrical signal; and utilizing a relay responsive to the electrical signal and in line between the at least one device and the controller for automatically switching the at least one device.

15. The method of preventing the engine from stalling of claim 14, including the steps of:

converting the RPM signal to another electrical signal when the engine is at a second specified RPM within the preselected low idle range; and automatically switching the at least one device in response to the another electrical signal from the second power output level to the first power output level.

16. The method of preventing the engine from stalling of claim 14, wherein the step of operating the at least one device includes the step of:

operating a switch.

17. The method of preventing the engine from stalling of claim 16, wherein the step of automatically switching the at least one device from the first power output level to the second power output level includes the step of:

utilizing the relay to totally disrupt the operation of the at least one device so that second output power level is zero.

18. The method of preventing the engine from stalling of claim 14, wherein the step of operating the at least one device includes the step of:

operating a solenoid valve.

19. The method of preventing the engine from stalling of claim 18, wherein the step of automatically switching the at least one device from the first power output level to the second power output level includes the step of:

utilizing the relay to totally disrupt the operation of the at least one device so that second output power level is zero.

20. The method of preventing the engine from stalling of claim 14, wherein the step of converting the RPM signal includes the step of:

selecting the first specified RPM at a lower RPM than the second specified RPM.

* * * * *